US007815774B2

(12) United States Patent
Tsuura et al.

(10) Patent No.: US 7,815,774 B2
(45) Date of Patent: Oct. 19, 2010

(54) ELEMENTS MADE BY PAPER-MAKING TECHNIQUE FOR THE PRODUCTION OF MOLDED ARTICLES AND PRODUCTION METHOD THEREOF

(75) Inventors: Tokuo Tsuura, Tochigi (JP); Hiroaki Kobayashi, Tochigi (JP); Yoshimasa Takagi, Tochigi (JP); Shigeo Nakai, Aichi (JP); Tokihito Sono, Tokyo (JP)

(73) Assignee: Kao Corporation, Tokyo (JP)

( * ) Notice: Subject to any disclaimer, the term of this patent is extended or adjusted under 35 U.S.C. 154(b) by 271 days.

(21) Appl. No.: 10/468,597

(22) PCT Filed: Mar. 10, 2003

(86) PCT No.: PCT/JP03/02792

§ 371 (c)(1),
(2), (4) Date: Aug. 20, 2003

(87) PCT Pub. No.: WO03/076104

PCT Pub. Date: Sep. 18, 2003

(65) Prior Publication Data

US 2004/0069429 A1 Apr. 15, 2004

(30) Foreign Application Priority Data

| | | |
|---|---|---|
| Mar. 13, 2002 | (JP) | 2002-069277 |
| Oct. 21, 2002 | (JP) | 2002-305848 |
| Feb. 28, 2003 | (JP) | 2003-054518 |

(51) Int. Cl.

| | |
|---|---|
| ***B22C 9/08*** | (2006.01) |
| ***B22C 1/00*** | (2006.01) |
| ***D21J 1/00*** | (2006.01) |

(52) U.S. Cl. ..... 162/218; 162/145; 162/148; 162/158; 162/181.6; 162/157.1; 428/34.1

(58) Field of Classification Search ..... 162/218, 162/222, 100, 141, 145–150, 152–156, 157.1, 162/158, 164.1, 164.3, 164.6, 165, 168.1–168.3, 162/169, 181.1, 181.8; 264/86–87, 101–102, 264/109, 112–113, 122, 172, 173.1, 175, 264/294, 344, 914; 428/34.1–34.3; 164/349, 164/369, 447, 520

See application file for complete search history.

(56) References Cited

U.S. PATENT DOCUMENTS 1,925,584 A * 9/1933 Fisher ..... 162/171

(Continued)

FOREIGN PATENT DOCUMENTS

BE 713368 8/1968

(Continued)

OTHER PUBLICATIONS

Machine Translation of Japanese Publication No. 05-0311128.*

(Continued)

*Primary Examiner*—José A Fortuna
(74) *Attorney, Agent, or Firm*—Birch, Stewart, Kolasch & Birch, LLP

(57) ABSTRACT

An element made by papermaking for use in the production of a casting cast which comprises an organic fiber, an inorganic fiber, and a binder. The contents of the organic fiber, the inorganic fiber, and the binder are preferably 10 to 70 parts by weight, 1 to 80 parts by weight, and 10 to 85 parts by weight, respectively. The binder is preferably an organic binder. The organic fiber is preferably pulp fiber.

18 Claims, 3 Drawing Sheets

U.S. PATENT DOCUMENTS

| | | | | | |
|---|---|---|---|---|---|
| 2,006,392 | A | * | 7/1935 | Greider et. al. | 162/127 |
| 2,269,455 | A | | 1/1942 | Hagemeyer | |
| 2,971,877 | A | * | 2/1961 | Arledter | 162/101 |
| 3,006,805 | A | * | 10/1961 | Waggoner | 162/101 |
| 3,236,719 | A | * | 2/1966 | Waggoner | 162/145 |
| 3,418,203 | A | * | 12/1968 | Asunmaa | 162/145 |
| 3,773,513 | A | * | 11/1973 | MacClaren | 430/538 |
| 3,844,337 | A | | 10/1974 | Bessett et al. | |
| 4,069,859 | A | | 1/1978 | Nagai et al. | |
| 4,081,168 | A | | 3/1978 | Atterbury et al. | |
| 4,251,320 | A | * | 2/1981 | Cederqvist et al. | 162/55 |
| 4,256,801 | A | | 3/1981 | Chuluda | |
| 4,291,781 | A | * | 9/1981 | Niguchi et al. | 181/169 |
| 4,356,994 | A | | 11/1982 | Thornton | |
| 4,789,430 | A | * | 12/1988 | Fredenucci | 162/145 |
| 4,923,665 | A | * | 5/1990 | Andersen et al. | 264/259 |
| 4,981,166 | A | | 1/1991 | Brown et al. | |
| 5,205,340 | A | | 4/1993 | Brown et al. | |
| 5,272,006 | A | | 12/1993 | Maine | |
| 5,569,320 | A | | 10/1996 | Sasaki et al. | |
| 5,611,848 | A | | 3/1997 | Sasaki et al. | |
| 5,830,548 | A | | 11/1998 | Andersen et al. | |
| 5,906,712 | A | * | 5/1999 | Asami et al. | 162/156 |
| 5,983,268 | A | | 11/1999 | Freivald et al. | |
| 5,989,390 | A | | 11/1999 | Lee | |
| 5,997,785 | A | * | 12/1999 | Skjelmose | 264/86 |
| 6,264,045 | B1 | | 7/2001 | Wilson et al. | |
| 6,278,448 | B1 | | 8/2001 | Brown et al. | |
| 6,331,358 | B1 | * | 12/2001 | Kitahara et al. | 428/447 |
| 6,335,387 | B1 | | 1/2002 | Twardowska et al. | |
| 6,488,811 | B1 | * | 12/2002 | Dong | 162/145 |
| 6,521,085 | B2 | * | 2/2003 | Kumamoto et al. | 162/130 |
| 6,533,897 | B2 | * | 3/2003 | Wang et al. | 162/145 |
| 6,540,874 | B1 | | 4/2003 | Ling-Chen et al. | |
| 6,616,802 | B1 | * | 9/2003 | Kinsley et al. | 162/101 |
| 6,616,804 | B2 | * | 9/2003 | Foster et al. | 162/129 |
| 6,733,628 | B2 | * | 5/2004 | Dinwoodie et al. | 162/145 |
| 6,841,041 | B2 | * | 1/2005 | Kumamoto et al. | 162/220 |
| 6,918,997 | B2 | * | 7/2005 | Goto et al. | 162/218 |
| 7,067,041 | B2 | * | 6/2006 | Tsuura et al. | 162/218 |
| 7,077,933 | B2 | * | 7/2006 | Otani et al. | 162/218 |
| 7,297,232 | B2 | * | 11/2007 | Tsuura et al. | 162/218 |
| 2001/0040016 | A1 | * | 11/2001 | Kumamoto et al. | 162/218 |
| 2002/0174963 | A1 | * | 11/2002 | Wang et al. | 162/152 |
| 2002/0189776 | A1 | * | 12/2002 | Kumamoto et al. | 162/218 |
| 2003/0029591 | A1 | * | 2/2003 | Otani et al. | 162/218 |
| 2003/0121635 | A1 | * | 7/2003 | Kumamoto et al. | 162/218 |
| 2003/0145968 | A1 | * | 8/2003 | Kumamoto et al. | 162/218 |
| 2003/0150582 | A1 | * | 8/2003 | Tsuura et al. | 162/218 |
| 2003/0150583 | A1 | * | 8/2003 | Goto et al. | 162/218 |
| 2003/0209337 | A1 | * | 11/2003 | Nonomura | 162/218 |
| 2004/0011489 | A1 | * | 1/2004 | Kimbara et al. | 162/218 |
| 2004/0041305 | A1 | * | 3/2004 | Tsuura et al. | 264/335 |
| 2004/0045690 | A1 | * | 3/2004 | Eto et al. | 162/225 |
| 2004/0069429 | A1 | * | 4/2004 | Tsuura et al. | 162/218 |
| 2006/0005937 | A1 | * | 1/2006 | Sakaguchi et al. | 164/15 |
| 2006/0130987 | A1 | * | 6/2006 | Tsuura et al. | 162/118 |
| 2008/0047676 | A1 | * | 2/2008 | Takagi et al. | 162/116 |
| 2008/0105401 | A1 | * | 5/2008 | Nakai et al. | 164/520 |
| 2009/0151885 | A1 | * | 6/2009 | Ootaki et al. | 162/218 |
| 2009/0211717 | A1 | * | 8/2009 | Takagi et al. | 162/145 |

FOREIGN PATENT DOCUMENTS

| | | | | |
|---|---|---|---|---|
| CN | 1041715 | A | | 5/1990 |
| CN | 1167020 | A | | 12/1997 |
| DE | 2632880 | | | 2/1977 |
| DE | 3039935 | A1 | | 5/1982 |
| EP | 0 062 193 | A1 | | 10/1982 |
| EP | 1 488 871 | A1 | | 12/2004 |
| EP | 1577034 | A1 | * | 9/2005 |
| FR | 2 085 544 | | | 4/1970 |
| FR | 2 246 516 | A1 | | 5/1975 |
| FR | 2475970 | | | 8/1981 |
| GB | 2047766 | A | | 12/1980 |
| JP | 43-13441 | | | 6/1968 |
| JP | 49-125222 | | | 11/1974 |
| JP | 50-077415 | A | | 6/1975 |
| JP | 50-20545 | | | 7/1975 |
| JP | 51-1286 | Y2 | | 1/1976 |
| JP | 53-48026 | | | 5/1978 |
| JP | 55-116751 | U | | 8/1980 |
| JP | 57-177846 | A | | 11/1982 |
| JP | 57-190747 | A | | 11/1982 |
| JP | 59-165743 | U | | 11/1984 |
| JP | 62-89758 | A | | 4/1987 |
| JP | 63-295037 | A | | 12/1988 |
| JP | 1-60742 | U | | 4/1989 |
| JP | 1-060742 | U | | 4/1989 |
| JP | 1-262041 | A | | 10/1989 |
| JP | 1-278935 | A | | 11/1989 |
| JP | 1-278935 | A | | 11/1989 |
| JP | 01278935 | A | * | 11/1989 |
| JP | 5-31128 | | | 2/1993 |
| JP | 5-31128 | A | | 2/1993 |
| JP | 6-327704 | A | | 11/1994 |
| JP | 6-86843 | U | | 12/1994 |
| JP | 08-267222 | A | | 10/1996 |
| JP | 9-253792 | A | | 9/1997 |
| JP | 11-254091 | | | 9/1999 |
| JP | 11-254091 | A | | 9/1999 |
| JP | 2004-195547 | A | | 7/2004 |
| KR | 0128008 | B1 | | 4/1998 |
| WO | WO 00/58556 | A1 | | 10/2000 |
| WO | WO 01/64527 | A1 | | 9/2001 |
| WO | WO 3076104 | A1 | * | 9/2003 |
| WO | WO 2004043627 | A1 | * | 5/2004 |

OTHER PUBLICATIONS

Machine Translation of Japanese Publication No. 06-327704.*
Machine Translation of Japanese Publication No. 11-254091.*
English language abstract of JP 08267222 (Oct. 15, 1996).
English language translation of JP 1-60742 U (Apr. 18, 1989).
English language translation of JP 53-48026 A (May 1, 1978).
Response to EP Office Action issued Aug. 17, 2007 in corresponding EP Application No. 3 710 293.6-2122 with Experimental Data submitted with Response on Jul. 15, 2008.
Experimental Data prepared in connection with corresponding EP Application No. 03 710 293, Mar. 26, 2010.

* cited by examiner

ELEMENTS MADE BY PAPER-MAKING TECHNIQUE FOR THE PRODUCTION OF MOLDED ARTICLES AND PRODUCTION METHOD THEREOF

This application is the national phase under 35 U.S.C. §371 of PCT International Application No. PCT/JP03/02792 which has an International filing date of Mar. 13, 2003, which designated the United States of America.

TECHNICAL FIELD

The present invention relates to an element made by papermaking technique which is used in the production of casts and a method of producing a cast using the element.

BACKGROUND ART

Production of casts generally involves making a casting mold having a cavity (and, if necessary, a core) of casting sand, forming a pouring cup, a sprue, a runner and a gate to make a passage leading to the cavity through which molten metal is fed to the cavity (these elements will hereinafter be referred to inclusively as a gating system), and additionally forming a vent, a feeder, and a flow-off which lead to the outside. The gating system, vent, feeder, and flow-off are formed integrally with the casting mold, or the gating system is assembled from elements made of refractories such as earthenware and brick.

Where a casting mold, a gating system, etc. are integrally formed of casting sand, it is difficult to design the gating system in a three-dimensional and complicated configuration. Moreover, sand must be prevented from entering molten metal. Where, on the other hand, elements made of refractories are used to form the gating system, it is necessary to prevent molten metal temperature drop due to heat loss, and the assembly of the elements is troublesome, involving joining refractory elements by tape winding. In addition, after casting, the refractories break due to thermal shock, etc. to produce a large quantity of industrial waste, the disposal of which is labor intensive. In cutting refractory to length, a high-speed cutter such as a diamond cutter must be used. In general, refractories are hard to handle.

The technique disclosed in JP-A-U-1-60742 (Japanese utility model laid-open publication) is among known methods addressing these problems. According to this technique, a heat-insulating material obtained by molding a slurry comprising organic or inorganic fiber and an organic or inorganic binder in a mold is used in a gating system, etc.

Since the heat-insulating material is molded from a mixture of organic or inorganic fiber and an organic or inorganic binder, (1) where an organic fiber and an organic binder are combined, the heat-insulating material thermally decomposes on molten metal feeding to cause the gating system to shrink largely, which can lead to molten metal leakage from the gating system. (2) Where an inorganic fiber and an inorganic binder are combined, it is difficult to mold into a heat-insulating material in a three-dimensional configuration (e.g., a hollow shape) or in a design with a joint, resulting in a failure to make a gating system, etc. matching various cavity shapes.

It is also known to use a core produced from cellulose fiber mixed with inorganic powder and/or inorganic fiber (see, e.g., JP-A-9-253792). Containing inorganic powder or inorganic fiber, the core can be produced with suppressed shrinkage on drying. By use of this core, generation of gas or tar-like polymers from cellulose fiber during casting can be suppressed. As a result, casting defects are reduced, and casting workability is improved.

Notwithstanding these advantages, the core according to this technique contains no binder. Therefore, it is not suited to assemble a gating system and the like including a hollow runner in conformity to various cavity shapes.

Accordingly an object of the present invention is to provide an element made by papermaking technique for use in the production of casts which is less liable to thermal shrinkage accompanying thermal decomposition, capable of assembling a gating system, etc. in conformity with various cavity shapes, and is easy to handle.

DISCLOSURE OF THE INVENTION

The present invention accomplishes the above object by providing an element made by papermaking technique for use in the production of casts (hereinafter referred to simply as "molded element", "element for casting" or more simply just as "element") which comprises an organic fiber, an inorganic fiber, and a binder.

The present invention also provides a method of producing a cast using an element made by papermaking technique which comprises an organic fiber, an inorganic fiber, and a binder, wherein the element is disposed in casting sand.

The present invention also provides a method of producing an element for use in the production of casts, which comprises the steps of forming a molded article by papermaking from a slurry containing an organic fiber and an inorganic fiber and incorporating a binder into the molded article.

BRIEF DESCRIPTION OF THE ACCOMPANYING DRAWINGS

BEST MODE FOR CARRYING OUT THE INVENTION

Figure 1:
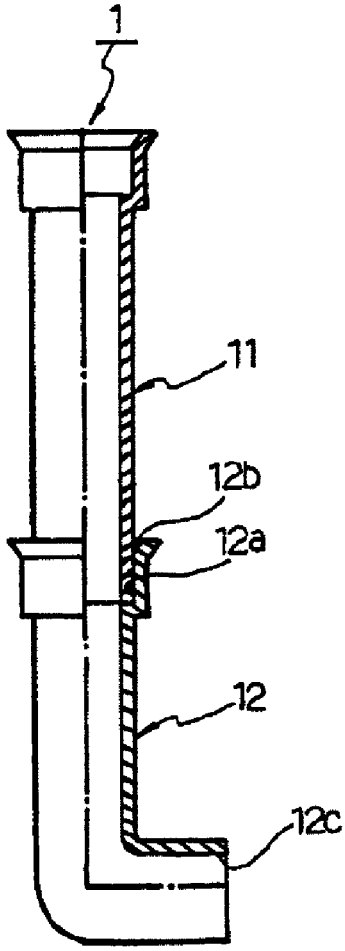
FIG. 1 is a schematic half cross-section showing an embodiment of the invention in which the element for casting is used as a sprue.

The present invention will be described with reference to its preferred embodiments.

The element according to the present invention comprises an organic fiber, an inorganic fiber, and a binder.

The organic fiber forms the skeleton of the element before being used in casting. On casting, part or the whole of the organic fiber burns by the heat of molten metal to leave voids in the element after casting.

The organic fiber includes paper fiber and fibrillated synthetic or regenerated fibers (e.g., rayon fiber). These fibers are used either individually or as a mixture of two or more thereof. Preferred of them is paper fiber for the following reasons. Paper fiber is easily and stably available and therefore contributory to reduction of molding cost. Paper fiber is easy to mold into a variety of shapes by papermaking technique. A paper fiber-molded article after dewatering and drying exhibits sufficient strength.

The paper fiber includes not only wood pulp but non-wood pulp, such as cotton pulp, linter pulp, bamboo, and straw. Virgin pulp or used paper (recycled) pulp can be used either alone or in combination thereof. From the standpoint of ease and stability of supply, environmental conservation, and reduction of production cost, used paper pulp is preferred.

It is preferred for the organic fiber to have an average length of 0.8 to 2.0 mm, particularly 0.9 to 1.8 mm. Where the average length of the organic fiber is too small, the resulting molded article can suffer from cracks on its surface or tends to have reduced mechanical properties, such as impact strength. Too large an average fiber length can result in thickness variation or deterioration of surface smoothness.

The content of the organic fiber is preferably 10 to 70 parts by weight, more preferably 20 to 60 parts by weight. The unit "part(s) by weight" as used throughout the description is based on 100 parts by weight of the total amount of an organic fiber, an inorganic fiber, and a binder. When the organic fiber content is too small, the slurry has reduced moldability due to shortage of organic fiber that is to form the skeleton of a molded article, and the molded article tends to have insufficient strength after dewatering and drying. Too much organic fiber generates a large amount of combustion gas on pouring molten metal. It can follow that molten metal erupts from the sprue or that the flow-off (a thin hollow pipe provided on the upper side of a casting mold, through which molten metal rises after filling the cavity) belches a vigorous flame. Use of an increased amount of some organic fibers results in increased cost of production.

The inorganic fiber forms the skeleton of the element for casting before being used in casting. On casting molten metal, it does not burn even with the heat of the molten metal and retains its shape. Where, in particular, an organic binder (described later) is used as a binder, the inorganic fiber is effective to suppress thermal shrinkage of the organic binder due to the heat of the molten metal.

The inorganic fiber includes artificial mineral fibers, such as carbon fiber and rock wool, ceramic fibers, and natural mineral fibers. They can be used either alone or in combination of two or more thereof. Carbon fiber having high strength in high temperatures is preferred for controlling the thermal shrinkage. Rock wool is preferred for reducing the production cost.

The inorganic fiber preferably has an average length of 0.2 to 10 mm, particularly 0.5 to 8 mm. Where the inorganic fiber has too short an average length, the slurry has reduced freeness, which can result in insufficient dewatering in producing the element. Further, the slurry may have poor moldability for making a thick-walled article, particularly a hollow article such as a bottle-shaped one. Where the inorganic fiber has too long an average length, the slurry tends to fail to produce a molded article with uniform wall thickness and may have difficulty in producing a hollow molded element.

The content of the inorganic fiber is preferably 1 to 80 parts by weight, more preferably 4 to 40 parts by weight. Where the inorganic fiber content is too small, the resulting molded element, particularly the one obtained using an organic binder, has reduced strength in casting, and the molded element tends to suffer from shrinkage, cracking, delamination (separation of the wall into an inner layer and an outer layer) and the like due to carbonization of the binder. Moreover, there is a fear that part of the molded element or casting sand may enter molten metal to produce a defective casting. A slurry having too high an inorganic fiber content has reduced molding properties particularly in the steps of papermaking and dewatering. Use of an increased amount of some inorganic fibers results in increased cost of production.

The weight ratio of the inorganic fiber to the organic fiber (i.e., inorganic fiber content/organic fiber content) is preferably 0.15 to 50, more preferably 0.25 to 30, in the case where the inorganic fiber is carbon fiber, and preferably 10 to 90, more preferably 20 to 80, in the case where the inorganic fiber is rock wool. A slurry containing too much inorganic fiber has reduced molding properties in papermaking and dewatering so that a molded article may break when removed from a papermaking mold. Where the proportion of the inorganic fiber is too small, the resulting molded element tends to shrink on account of thermal decomposition of the organic fiber or an organic binder hereinafter described.

The binder includes organic binders and inorganic binders as hereinafter described. The organic binders and the inorganic binders can be used either individually or as a mixture thereof.

The organic binder may be incorporated into a slurry for producing a molded article or infiltrated into a molded article. Where added to a slurry, the binder binds the organic fiber and the inorganic fiber during drying a molded article to provide a high strength element. Where infiltrated into a molded article, the binder cures on drying the impregnated article and carbonizes on casting by the heat of molten metal, whereby the molded element maintains strength during casting.

The organic binders include thermosetting resins, such as phenol resins, epoxy resins, and furan resins. Preferred of them are phenol resins in view of reduced generation of combustible gas, inhibitory effect on burning, and a high carbon residue content after thermal decomposition (carbonization). The phenol resins to be used include novolak phenol resins that require a curing agent as described later and those requiring no curing agent such as resol type ones. The organic binders can be used either individually or as a mixture of two or more thereof.

The inorganic binders include those capable of binding the organic fiber and the inorganic fiber when a molded article is dried (before casting), those which remain on casting to suppress generation of combustion gas or flame, those which melt by the heat on casting to manifest the ability as a binder, and those effective in inhibiting carburizing on casting.

The inorganic binders include compounds mainly comprising $SiO_2$, such as colloidal silica, obsidian, perlite, ethyl silicate, and water glass. Among them colloidal silica is preferred in view of its independent utility and ease of application, and obsidian is preferred from the standpoint of capability of being added to a slurry and prevention of carburizing. The inorganic binders can be used either individually or as a mixture of two or more thereof.

The content of the binder is preferably 10 to 85 parts by weight, more preferably 20 to 80 parts by weight, on a solid basis. Too small a binder content can result in pinholes of the element or reduction in compressive strength of the element. Where the organic binder is used, there tend to be cases in which the casting sand enters a cast product during casting due to insufficient strength of the element. Where the binder content is too large, a molded article tends to stick to a mold on drying and have difficulty in removal from the mold.

Where a binder other than obsidian is used, a preferred content of the binder is 10 to 70 parts by weight, particularly 20 to 50 parts by weight. Where obsidian is used as a binder, it is preferably used in an amount of at least 20 parts by weight in the total binder. The binder may consist solely of obsidian.

Where a novolak phenol resin is used in the production of the element for casting, a curing agent is required. Because a curing agent is soluble in water, it is preferably applied to the surface of a dewatered molded article. Hexamethylenetetramine is a preferred curing agent.

Two or more kinds of binders different in melting point or thermal decomposition temperature can be used in combination. In order for the element to retain its shape in ambient temperature before casting until after it is exposed to a high casting temperature and in order to prevent carburizing during casting, it is preferred to use a low-melting binder and a high-melting binder in combination. In this case, the low-melting binder includes clay, water glass, and obsidian, and the high-melting binder includes colloidal silica, wollastonite, mullite, and $Al_2O_3$. A combination of obsidian and a phenol resin is an example of the combination of binders different in melting point or thermal decomposition temperature. Obsidian has a melting point of 1200° C. to 1300° C., and phenol resins have a thermal decomposition temperature of about 500° C. As a result of measurement of weight loss on heating in nitrogen gas (TG-DTA), a phenol resin 40 wt % decomposes, and about 50% of the decomposable component decomposes at about 500° C.

The element for casting according to the present invention can contain a paper strengthening agent in addition to the organic fiber, the inorganic fiber, and the binder. When a preform of a molded article is impregnated with a binder as described infra, the paper strengthening agent serves to prevent the preform from swelling.

A preferred amount of the paper strengthening agent to be used is 1 to 20%, particularly 2 to 10%, based on the total weight of the fibers. Where added in too small an amount, the paper strengthening agent produces an insubstantial effect on swelling prevention or tends to fail to be fixed onto the fibers. With too much paper strengthening agent added, no further effect results, and a molded article tends to stick to the mold.

The paper strengthening agent includes polyvinyl alcohol, carboxymethyl cellulose (CMC), and a polyamideamine-epichlorohydrin resin.

The element for casting according to the present invention can further contain such components as a coagulant and a colorant.

The thickness of the molded element for casting is subject to variation according to the purpose of use. At least the part of the element which comes into contact with molten metal preferably has a thickness of 0.2 to 5 mm, particularly 0.4 to 3 mm. Too thin an element has insufficient strength and tends to yield to the pressure of casting sand and have difficulty in retaining its shape and functions as required. Too thick an element has reduced air permeability, incurs increase of material cost, requires a longer molding time, and eventually results in increase of production cost.

The molded element for casting preferably has a compressive strength of 10 N or higher, particularly 30 N or higher, before use in casting. With too low compressive strength, the element tends to be deformed under pressure of casting sand and deteriorate in function.

Where the element for casting is produced by papermaking using a slurry containing water, it is preferred for the element before use (before use in casting) to have a water content of not more than 10% by weight, particularly 8% by weight or less. The lower the water content, the less the amount of gas generated by the thermal decomposition (carbonization) of the organic binder on casting.

The specific gravity of the molded element for casting before use is preferably 1.0 or lower, more preferably 0.8 or lower. The lower the specific gravity, the lighter the element, which will facilitate handling and processing of the molded element.

The method of producing the element for casting will then be described with reference to an example in which a hollow molded element for casting is produced.

A slurry comprising the organic fiber, the inorganic fiber, and the binder in the above-recited ratio is prepared. The slurry is prepared by dispersing the fibers and the binder in a prescribed dispersing medium. The binder may be infiltrated into a molded article instead of being added to the slurry.

The dispersing medium includes water, white water, and solvents such as ethanol and methanol. Water is particularly preferred in view of stability in papermaking and dewatering, stability of quality of molded articles, cost, and ease of handling.

The slurry preferably contains the fibers in a total weight of 0.1 to 3%, particularly 0.5 to 2%, by weight based on the dispersing medium. A slurry containing too much fiber can result in thickness unevenness of a molded article and poor surface conditions on the inner side of a hollow molded article. A slurry containing too little fiber can result in formation of a thin-walled part in the resulting molded article.

If desired, the slurry can contain additives including the above-described paper strengthening agent and coagulant and an antiseptic.

A preform, i.e., a precursor of the molded element for casting, is formed using the slurry.

The papermaking step for preparing a preform is carried out using a papermaking/dewatering mold which is composed of a pair of splits that are joined together to form a cavity in conformity to the contour of the preform. A predetermined amount of the slurry is poured under pressure (injected) into the cavity through an opening at the top of the mold thereby applying a predetermined pressure to the wall of the cavity. Each of the splits has a plurality of interconnecting holes connecting the cavity and the outside. The inner wall of each split is covered with a screen having a predetermined mesh size. The slurry is injected by means of, for example, a pressure pump. The injection pressure of the slurry is preferably 0.01 to 5 MPa, more preferably 0.01 to 3 MPa.

Since a prescribed pressure is applied to the cavity wall as stated above, the dispersing medium of the slurry is drained out of the mold through the interconnecting holes. Meanwhile the solid content of the slurry is accumulated on the screen covering the cavity wall to build up a fiber layer with uniform thickness. Because the resulting fiber layer comprises the organic fiber and the inorganic fiber in a complicatedly entangled state with the binder existing among the individual fibers, it has high shape retention even after drying however complicated the shape may be. With a prescribed pressure being applied to the cavity, the slurry is circulated and thereby agitated within the cavity. As a result, the slurry in the cavity is uniform in concentration to deposit a fiber layer on the screen uniformly.

On depositing a fiber layer to a predetermined thickness, the slurry injection is stopped. Air is introduced into the cavity under pressure to press dewater the fiber layer. After air introduction is stopped, the cavity is sucked through the interconnecting holes, and an elastically expandable hollow pressing member (elastic pressing member) is inserted into the cavity. The pressing member is made of urethane, fluororubber, silicone rubber, an elastomer, etc. that are excellent in tensile strength, impact resilience, expandability and contractibility.

A pressurizing fluid is fed into the pressing member inserted in the cavity thereby to expand the pressing member. The fiber layer is pressed onto the inner wall of the cavity by the expanded pressing member. While the fiber layer is thus pressed toward the inner wall of the cavity, the inner shape of the cavity is transferred to the outer side of the fiber layer, and the fiber layer is dewatered at the same time.

The pressurizing fluid used to inflate the pressing member includes compressed air (heated air), oil (heated oil), and other various liquids. The feed pressure of the fluid is preferably 0.01 to 5 MPa with molded article production efficiency taken into account. For assuring higher production efficiency, 0.1 to 3 MPa is more preferred. Under pressures lower than 0.01 MPa, the drying efficiency of the fiber layer reduces, and shape transfer properties and the surface properties of the resulting preform tend to be insufficient. Greater pressures than 5 MPa bring no further effects only to require larger size equipment.

Since the fiber layer is pressed from its inside to the inner wall of the cavity, the cavity's inner shape can be transferred to the outer surface of the fiber layer with good precision no matter how complicated the shape may be. Besides, even where an element to be molded has a complicated shape, it is produced without involving the step of joining separately prepared parts. Therefore, the finally produced element has neither joint seams nor thick-walled parts.

After the inner shape of the cavity has been sufficiently transferred to the outer side of the fiber layer, and the fiber layer has been dewatered to a predetermined water content, the pressurizing fluid is withdrawn from the pressing member to let the pressing member shrink to its original size. The shrunken pressing member is removed from the cavity, and the mold is opened to take out the fiber layer which is still wet with the predetermined water content. It is possible that the above-described step of press dewatering the fiber layer by the pressing member is omitted. In this case, the fiber layer is dewatered and shaped simply by introducing air into the cavity under pressure.

The thus dewatered fiber layer is then transferred to the step of heat drying.

In the heat drying step, a drying mold is used, which has a cavity in conformity with the contour of the preform. The mold is heated to a predetermined temperature, and the dewatered but still wet fiber layer is fitted therein.

A pressing member similar to that used in the papermaking step is inserted inside the fiber layer, and a pressurizing fluid is fed into the pressing member to inflate the pressing member. The fiber layer is pressed by the inflated pressing member toward to inner wall of the cavity. It is desirable to use a pressing member whose surface has been modified with a fluorine resin, a silicone resin, and the like. The feed pressure of the pressurizing fluid is preferably the same as in the dewatering step. In this state, the fiber layer is heat dried (the preform is dried).

The heating temperature of the mold for drying (the mold temperature) is preferably 180 to 250° C., more preferably 200 to 240° C., from the viewpoint of surface properties and drying time. Too high heating temperatures can burn the preform to impair the surface properties. Too low heating temperatures need longer drying time.

After the fiber layer is dried sufficiently, the pressurizing fluid is withdrawn from the pressing member to shrink the pressing member. The shrunken pressing member is removed from the fiber layer. The mold is opened to remove the preform.

If necessary, the resulting preform may further be partly or wholly impregnated with a binder. The binder to be infiltrated into the preform includes a resol type phenol resin, colloidal silica, ethyl silicate, and water glass.

Where the slurry contains no binder, and the preform is impregnated with a binder afterward, it is simpler to treat the slurry or white water.

The binder-impregnated preform is heat dried at a predetermined temperature to thermally cure the binder. The preform production thus completes.

Having been pressed by the elastic pressing member, the resulting element made by papermaking has high smoothness on both the inner and outer surfaces and therefore enjoys high molding precision. Even an element having a part to be joined with another element or a threaded part can be obtained with high accuracy. Therefore, elements connected at the joints or the threads are securely proof against molten metal leaks and allow molten metal to flow therethrough smoothly. Further, the thermal shrinkage of the element on casting is less than 5% so that molten metal leaks due to cracks or deformation of the element can be prevented without fail.

The molded element for casting according to the present invention is useful as a sprue as in the embodiment shown in FIG. 1, in which numeral 1 indicates a sprue.

As shown in FIG. 1, the sprue 1 is composed of two cylindrical elements 11 and 12 connected by fitting. The upper opening portion 12*a* of the cylindrical element 12 has an increased diameter over a predetermined length, and the tip 12*b* of the opening portion 12*a* has its inner side tapered with the inner diameter increasing upward (reverse tapered). Thus, the lower end opening portion of another element (the cylindrical element 11 in FIG. 1) can easily and securely be fitted into the opening portion 12*a* to a predetermined depth.

The diameter of the opening portion 12*a* of the cylindrical element 12 is increased so that the inner surface of the cylindrical elements 11 and 12 may form a single plane. The lower part of the cylindrical element 12 is bent in a horizontal direction. To the opening portion 12*c* of the horizontal portion is connected a runner 3 (see FIG. 3).

Figure 2A:
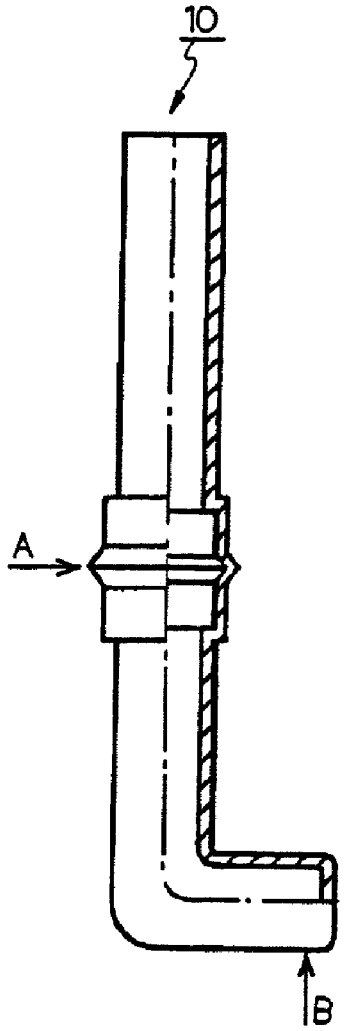
FIG. 2 is a schematic half cross-section of a preform (precursor) of the element according to the above embodiment, in which FIG. 2(*a*) shows the state before cutting, and FIG. 2(*b*) the state after cutting.
Figure 2B:
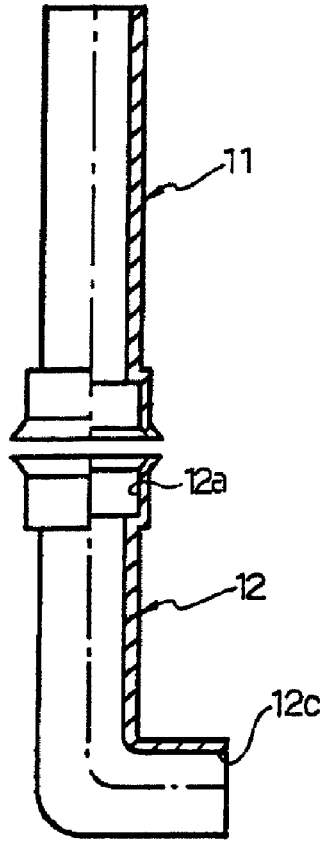

The sprue 1 is preferably produced by making a preform 10 shown in FIG. 2(*a*). The preform 10 is composed of integrally molded cylindrical elements 11 and 12. The cylindrical element 11 is integrally connected in its inverted state to the upper end of the cylindrical element 12, and the end of the horizontal part of the cylindrical element 12 (which becomes an opening 12*c*) is closed.

As shown in FIG. 2(*b*), the resulting preform 10 is cut at predetermined positions (A and B in FIG. 2(*a*)). The thus separated elements are connected by fitting as shown in FIG. 1 to make a sprue with a bend (element for casting; see FIG. 3.)

The method of producing a cast will be described with reference to the production of a cast by use of the sprue 1.

Figure 3:
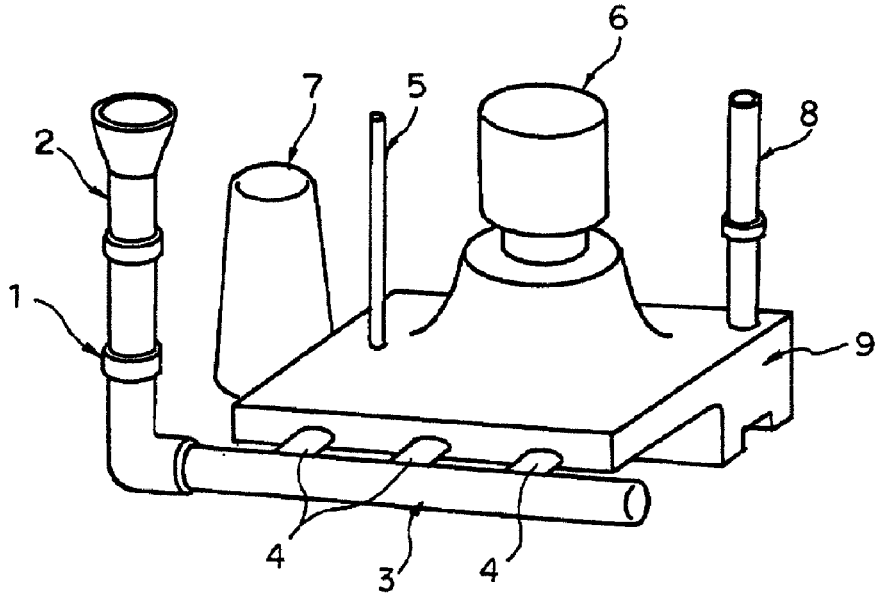
FIG. 3 is a perspective schematically showing arranged elements of the invention.

As shown in FIG. 3, elements for casting made by papermaking, i.e., the elements for a gating system (the sprue 1, a pouring cup 2, a runner 3, and gates 4), a vent 5, top and side risers 6 and 7, a flow-off 8, and a casting mold 9 having a cavity (not shown) are assembled according to a prescribed configuration.

The assembled elements for casting are buried in casting sand. Molten metal having a prescribed composition is fed to the cavity of the casting mold 9 through the gating system. Where the organic binder is used as a binder, the binder and the organic fiber thermally decompose and carbonize by the heat of the molten metal but retain sufficient strength. Because the inorganic fiber suppresses thermal shrinkage accompanying the thermal decomposition, each element is substantially prevented from cracking or flowing away together with the molten metal so that incorporation of casting sand into the molten metal does not occur. After the casting mold is disintegrated to take out the cast, it is easy to remove the elements from the surface of the cast because the organic fiber has decomposed thermally.

Casting sands conventionally employed for this type of casting can be used without particular restriction.

After completion of the casting, the casting mold is cooled to a prescribed temperature. The casting sand is removed, and the cast product is exposed by blasting. Unnecessary parts such as the carbonized elements, such as the gating system elements, are also removed. If needed, casting is worked-up by trimming, and the like to complete the production of a cast.

As described, the molded element for casting according to the present invention has its organic fiber burnt by the heat of molten metal to leave voids inside. The strength of the element is maintained by the inorganic fiber and the binder. After disintegration of the casting mold, the element can easily be separated and removed from casting sand by blasting or like treatment. In other words, the element of the present invention retains its strength while a casting mold is shaped or during casting and reduces its strength after disintegration of the mold because of use of the organic fiber, the inorganic fiber, and the binder. Accordingly, the method of producing casts using the element of the present invention simplifies disposal of waste, reduces the cost of disposal, and reduces the waste itself.

Where in using the element which is produced by using an elastic pressing member and therefore has satisfactory surface conditions, there is formed a three-dimensional flow passage (i.e., a gating system) which causes no turbulence of molten metal while cast. As a result, casting defects caused by entrapment of air, dust, etc. due to molten metal turbulence can be prevented.

Additionally, the element of the present invention which is produced by papermaking technique from a slurry comprising the organic fiber, the inorganic fiber, and the binder is effective in suppressing flaming during casting as compared with an element produced using only the organic fiber. Furthermore, the element of the present invention is prevented from reducing the strength due to combustion of the organic fiber and cracking due to thermal shrinkage accompanying thermal decomposition (carbonization) of the organic binder. As a result, casting defects due to incorporation of casting sand into the molten metal can be avoided.

Having air permeability, the element of the present invention allows gas generated on casting to escape toward the casting sand. Production of defective casts attributed to so-called blowholes is thus prevented.

The molded element for casting according to the present invention is lightweight and easy to cut with a simple tool and is therefore excellent in handling properties.

The present invention is not limited to the above-described embodiments, and various changes and modifications can be made therein without departing from the spirit and scope thereof.

For example, the element can have means for adjusting its length, which makes the element more convenient to handle. The length adjusting means includes the following methods. Where two elements are to be connected, the inner side of one element and the outer side of the other are male/female threaded so that the total length of the two elements may be adjusted by the degree of screwing in; or a cylindrical element may have bellows provided in its lengthwise middle so that the length of the element may be adjusted by extending or contracting the bellows.

Figure 4:
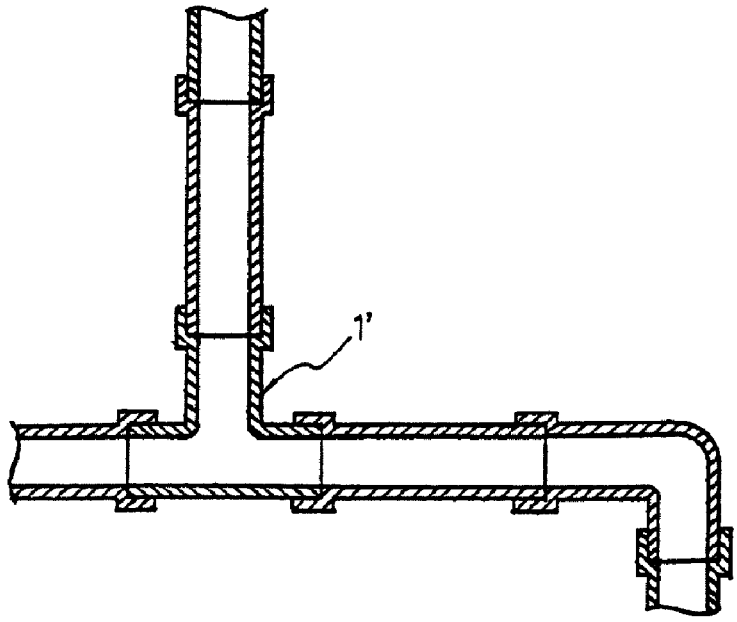
FIG. 4 is a schematic cross-section showing connections of the elements of the invention in another embodiment of the present invention.

The element for casting according to the present invention can be applied to not only a non-branched configuration such as the sprue 1 but a T-shaped sprue 1' shown in FIG. 4. In this way, a gating system can be designed to have a variety of configurations as shown in FIG. 4.

The element for casting according to the present invention can be used as not only the sprue 1 as in the above-described embodiment but the pouring cup, the runner, the gate, the vent, the riser, the flow-off (numerals 2 to 8), a core (not shown), the casting mold itself, which are shown in FIG. 3, and a runner on the inner side of the mold.

The element for casting according to the present invention can be shaped into a cylindrical sprue having a slag trap portion. The slag trap portion has a filter effect to produce a cast with higher purity.

While in the above embodiment a novolak type phenol resin is used, a resol type phenol resin is also useful. In this case, it is possible that a sprue is molded by papermaking using a slurry containing the resol type phenol resin, dewatering, and impregnating the resulting wet preform with the resin. It is also possible that the phenol resin is infiltrated into the dried preform followed by heat treatment.

The method of producing a cast according to the present invention is applicable to not only cast iron but nonferrous metals, such as aluminum and its alloys, copper and its alloys, nickel, and lead.

The present invention will now be illustrated in greater detail with reference to Examples.

EXAMPLE 1

A prescribed fiber layer was made by papermaking using a slurry shown below. The fiber layer was dewatered and dried to obtain a sprue (element for casting; weight: about 16 g) having the shape shown in FIG. 2(*a*) and the following physical property.

Preparation of the Slurry I:

The organic fiber and the inorganic fiber described below were dispersed in water to prepare an about 1% slurry (a total content of the organic fiber and the inorganic fiber was 1% by weight with respect to water). The binder and the coagulant shown below were added to the slurry (to prepare a stock). The weight mixing ratio of the organic fiber, inorganic fiber and binder was as shown below.

Composition of the Slurry I:

Organic fiber: recycled newspapers; average fiber length: 1 mm; freeness (CSF-Canadian Standard Freeness): 150 cc Inorganic fiber: Carbon fiber (Torayca chopped fiber, available from Toray Industries, Inc.; fiber length: 3 mm) was beaten.

The organic fiber, the inorganic fiber, and the phenol resin were mixed into a slurry at a weight ratio of 2:3:5. The resulting slurry had a freeness of 300 cc.

Binder: phenol resin (SP1006LS, available from Asahi Organic Chemicals Industry Co., Ltd.)

Coagulant: polyacrylamide coagulant (A110, available from Mitsui Cytec Ltd.)

Dispersing medium: water

Organic fiber:inorganic fiber:binder=2:3:5 (by weight)

Papermaking and Dewatering Steps:

A papermaking mold having a cavity corresponding to the shape shown in FIG. 2(*a*) was used. A screen of predetermined mesh size was disposed on the cavity-forming surface of the mold. The mold had a large number of interconnecting holes connecting the cavity-forming surface and the outside. The mold was a split mold composed of a pair of splits.

The slurry I was circulated by a pump. A predetermined amount of the slurry I was injected into the papermaking mold while removing water from the slurry I through the interconnecting holes thereby to deposit a prescribed fiber layer on the screen. After the predetermined amount of the slurry I was injected, pressurized air was introduced into the papermaking mold to dewater the fiber layer. The pressure of the pressurized air was 0.2 MPa. The time required for dewatering was about 30 seconds.

Curing Agent Application Step:

In water was dispersed hexamethylenetetramine (curing agent) in an amount corresponding to 15% by weight of the binder. The resulting dispersion was uniformly applied to the entire surface of the resulting fiber layer.

Drying Step:

A drying mold having a cavity-forming surface corresponding to the shape shown in FIG. 2(*a*) was used. The mold had a large number of interconnecting holes connecting the cavity-forming surface and the outside. The mold was a split mold composed of a pair of splits.

The fiber layer coated with the curing agent was removed from the papermaking mold and transferred into the drying mold heated to 220° C. A bag-shaped elastic pressing member was inserted into the drying mold from the top opening. A pressurizing fluid (pressurized air, 0.2 MPa) was introduced into the elastic pressing member in the closed drying mold to expand the pressing mold. The fiber layer was pressed to the inner wall of the drying mold by the pressing member thereby transferring the inner shape of the drying mold to the surface of the fiber layer while drying the fiber layer. After press drying for a predetermined time (180 seconds), the pressurizing fluid was withdrawn from the elastic pressing member to shrink the elastic pressing member. The shrunken pressing member was taken out of the drying mold, and the resulting molded article was removed from the drying mold and cooled.

Cutting and Assembly Steps:

The resulting molded article was cut as shown in FIG. 2(*b*), and the cut pieces were fitted together to form a sprue as shown in FIG. 1.

Physical Property of Sprue:

Thickness: 0.8 to 1.0 mm

EXAMPLE 2

A prescribed fiber layer was formed by papermaking using the slurry II shown below. The fiber layer was dewatered and dried to obtain a preform having the shape shown in FIG. 2(*a*). The preform was impregnated with a binder as described infra, followed by drying to heat-cure the binder to obtain a sprue (element for casting; weight: about 28 g) having the physical property shown below.

Preparation of the Slurry II:

The organic fiber and the inorganic fiber described below were dispersed in water to prepare an about 1% slurry (a total content of the organic fiber and the inorganic fiber was 1% by weight with respect to water). The binder and the coagulant shown below were added to the slurry (to prepare a stock). The weight mixing ratio of the organic fiber, inorganic fiber and binder is shown below.

Composition of the Slurry II:

Organic fiber: recycled newspapers; average fiber length: 1 mm; CSF: 150 cc

Inorganic fiber: Carbon fiber (Torayca chopped fiber, available from Toray Industries, Inc.; fiber length: 3 mm) was beaten.

The organic fiber and the inorganic fiber were mixed into a slurry at a weight ratio of 2:1. The resulting slurry had a freeness of 300 cc.

Binder: obsidian (Nicecatch, available from Kinseimatec Co., Ltd.)

Paper strengthening agent: polyvinyl alcohol fiber (5% by weight with respect to the organic fiber)

Coagulant: polyacrylamide coagulant (A110, available from Mitsui Cytec Ltd.)

Dispersing medium: water

Organic fiber:inorganic fiber:binder=20:10:40 (by weight)

Papermaking and Dewatering Steps:

A fiber layer was formed by papermaking and dewatered in the same manner as in Example 1.

Drying Step:

The same drying mold as in Example 1 was used. The fiber layer removed from the papermaking mold was transferred into the drying mold heated to 220° C. A bag-shaped elastic pressing member was inserted into the drying mold from the top opening. Drying was carried out in the same manner as in Example 1 to obtain a preform.

Binder Impregnating Step:

The resulting preform was immersed in a binder (resol type phenol resin liquid) to infiltrate the binder into the whole of the molded article.

Drying and Curing Step:

The preform was dried in a drying oven at 150° C. for about 30 minutes to heat-cure the binder.

The resulting preform had an organic fiber:inorganic fiber: binder (obsidian+phenol resin) weight ratio of 20:10:55 (40+15).

Cutting and Assembly Steps:

The resulting preform was cut as shown in FIG. 2(*b*) and fitted together as shown in FIG. 1 to obtain a sprue.

Physical Property of Sprue:

Thickness: 0.7 to 1.1 mm

Production of a Cast:

A gating system as shown in FIG. 3 was assembled using each of the sprues obtained in Examples 1 and 2. A casting mold was set up. A molten metal (1400° C.) was poured from the pouring cup.

Evaluation of Sprue after Casting:

In casting using each of the sprues, neither eruption of the molten metal from the pouring cup nor a vigorous flame from the flow-off was observed. After casting, the casting mold was disintegrated to find the sprue covering the solidified metal. The sprue was easily removed from the metal by blasting.

As described, it was confirmed that the sprues (elements for casting) obtained in Examples 1 and 2 are prevented from thermal shrinkage accompanying thermal decomposition, have capability of making a gating system, etc. in conformity to various mold cavity configurations, and are excellent in handling properties.

INDUSTRIAL APPLICABILITY

The present invention provides a molded element for casting which is prevented from thermal shrinkage accompanying thermal decomposition, has capability of making a gating system, etc. in conformity to various mold cavity configurations, and is excellent in handling properties.

The invention claimed is:

1. An element made by papermaking for use in the production of a cast, which comprises:

an organic fiber;

a carbon fiber; and at least-two binders existing among the individual fibers, wherein the organic fiber content is 10 to 60 parts by weight, the carbon fiber content is 4 to 40 parts by weight, and the at least two binders content is 10 to 85 parts by weight each per 100 parts by weight of the total of the organic fiber, the carbon fiber, and the at least two binders, the carbon fiber has an average length of 0.5 to 10 mm, the element is hollow, the element has no joint seams, the element contains a flow passage for molten metal, the element has both an inlet and an outlet through which a fluid can flow, the outlet being separated from the inlet, and the at least two binders comprise an organic binder and an inorganic binder.

2. The element made by papermaking for use in the production of a cast according to claim 1, wherein the at least two binders comprises two or more kinds of binders different in melting point or thermal decomposition temperature.

3. The element made by papermaking for use in the production of a cast according to claim 1, wherein the inorganic binder is a compound mainly comprising $SiO_2$.

4. The element made by papermaking for use in the production of a cast according to claim 1, wherein the organic fiber is a cellulosic fiber.

5. The element made by papermaking for use in the production of a cast according to claim 1, which element contains means for controlling a length thereof.

6. The element made by papermaking for use in the production of a cast according to claim 1, which is composed of a plurality of connectable parts.

7. A method of producing a cast using the element according to claim 1, comprising the steps of:

burying the element in casting sand;

feeding molten metal into the inlet and flow passage for molten metal of the element; and obtaining a cast.

8. A method of producing the element according to claim l, which comprises the steps of:

obtaining a slurry comprising the organic fiber and the carbon fiber;

forming a molded article from the slurry; and incorporating at least two binders into the molded article so as to obtain said element, wherein the at least two binders comprise an organic binder and an inorganic binder.

9. A method of producing the element according to claim 1, which comprises the steps of:

obtaining a slurry comprising the organic fiber and the carbon fiber and at least two binders; and forming a molded article from the slurry, so as to obtain said element, wherein the at least two binders comprise an organic binder and an inorganic binder.

10. The element made by papermaking for use in the production of a cast according to claim 1, wherein the organic fiber content is 20 to 60 parts by weight.

11. The element made by papermaking for use in the production of a cast according to claim 1, wherein the carbon fiber has an average length of 3.0 to 10 mm.

12. The element made by papermaking for use in the production of a cast according to claim 1, wherein the inorganic binder is obsidian.

13. A method of producing a cast, which utilizes therein an element which is hollow, which has no joint seams, comprises an organic fiber, a carbon fiber, and at least two binders existing among the individual fibers, wherein the organic fiber content is 10 to 60 parts by weight, the carbon fiber content is 4 to 40 parts by weight, and the at least two binders content is 10 to 85 parts by weight each per 100 parts by weight of the total of the organic, fiber, the carbon fiber, and the at least two binders; wherein the carbon fiber has an average length of 0.5 to 10 mm, the element contains a flow passage for molten metal, the element has both an inlet and an outlet through which a fluid can flow, the outlet being separated from the inlet, and the at least two binders comprise an organic binder and an inorganic binder;

said method comprising the steps of:

feeding molten metal into the inlet and flow passage for molten metal of the element; and obtaining said cast.

14. The method of producing a cast according to claim 13, wherein the carbon fiber has an average length of 3.0 to 10 mm.

15. The method of producing a cast according to claim 13, wherein the inorganic binder is obsidian.

16. A casting mold, comprising:

an element made by papermaking for use in the production of a cast, which comprises:

an organic fiber;

a carbon fiber; and at least two binders existing among the individual fibers, wherein the organic fiber content is 10 to 60 parts by weight, the carbon fiber content is 4 to 40 parts by weight, and the at least two binders content is 10 to 85 parts by weight each per 100 parts by weight of the total of the organic fiber, the carbon fiber, and the at least two binders, the carbon fiber has an average length of 0.5 to 10 mm, the element is hollow, the element contains a casting mold having a vent, and the element contains both an inlet and an outlet through which a fluid can flow, the outlet being separated from the inlet, wherein the at least two binders comprise an organic binder and an inorganic binder.

17. The casting mold according to claim 16, wherein the carbon fiber has an average length of 3.0 to 10 mm.

18. The casting mold according to claim 16, wherein the inorganic binder is obsidian.

* * * * *